US007263962B2

(12) United States Patent
Ohara

(10) Patent No.: US 7,263,962 B2
(45) Date of Patent: Sep. 4, 2007

(54) INTAKE SYSTEM OF ENGINE

(75) Inventor: Minao Ohara, Hamamatsu (JP)

(73) Assignee: Suzuki Motor Corporation, Hamamatsu-shi, Shizuoka-ken (JP)

( * ) Notice: Subject to any disclaimer, the term of this patent is extended or adjusted under 35 U.S.C. 154(b) by 0 days.

(21) Appl. No.: 11/455,465

(22) Filed: Jun. 19, 2006

(65) Prior Publication Data

US 2007/0012276 A1 Jan. 18, 2007

(30) Foreign Application Priority Data

Jul. 12, 2005 (JP) ..... 2005-203173

(51) Int. Cl.
*F02M 35/14* (2006.01)
*F02M 35/10* (2006.01)
*F02M 35/02* (2006.01)

(52) U.S. Cl. ..... 123/184.57; 123/184.61; 123/184.53; 123/198 E

(58) Field of Classification Search ..... 123/184.57, 123/184.53, 184.47, 184.21, 184.61, 198 E, 123/195 C; 181/204, 214, 240
See application file for complete search history.

(56) References Cited

U.S. PATENT DOCUMENTS

| | | | | |
|---|---|---|---|---|
| 5,908,017 | A * | 6/1999 | Kaneko | 123/195 A |
| 5,950,586 | A * | 9/1999 | Ropertz | 123/184.42 |
| 6,026,775 | A * | 2/2000 | Yamane | 123/184.53 |
| 6,817,332 | B2 * | 11/2004 | Tohyama | 123/184.57 |

FOREIGN PATENT DOCUMENTS

| | | | |
|---|---|---|---|
| JP | H11-125158 | | 5/1999 |
| JP | 2002155818 | A * | 5/2002 |
| JP | 2003035223 | A * | 2/2003 |
| JP | 2003074432 | A * | 3/2003 |
| JP | 2003-161217 | | 6/2003 |
| JP | 2006233927 | A * | 9/2006 |
| WO | WO-98/49440 | A1 * | 11/1998 |

* cited by examiner

*Primary Examiner*—Stephen K. Cronin
*Assistant Examiner*—Ka Chun Leung
(74) *Attorney, Agent, or Firm*—Flynn, Thiel, Boutell & Tanis, P.C.

(57) ABSTRACT

The purpose of the intake system, which is disposed in a limited space above the engine, is to improve engine performance by preventing increase in both temperature and resistance of intake air, and also to reduce noise of the intake air. In the intake system, a rear wall extending downwardly is formed in a lower half body that is joined to a rear end of an engine cover, and a mounting frame section for attaching an element is formed in a rear wall section. An upstream-side casing is formed forward of the rear wall section. An intake duct has a downstream end connected to a front surface of the upstream-side casing adjacent to a transmission. Further, the intake duct extends widthwise of the vehicle and has an upstream end opened to the side edge of the engine cover adjacent to the transmission. A resonance chamber casing is joined to the side departing from the transmission through a communication pipe forward of the upstream-side casing. The resonance chamber casing is formed to extend along the full width of the engine cover so as to cover the front of the intake duct.

3 Claims, 5 Drawing Sheets

INTAKE SYSTEM OF ENGINE

FIELD OF THE INVENTION

This invention relates to intake systems of an engine, and more particularly to an intake system of the engine which is disposed in a limited space above the engine, and improves the engine performance by preventing increase in both temperature and resistance of the intake air, and also reduces the noise of the intake air.

BACKGROUND OF THE INVENTION

The engine mounted in an engine room of the vehicle is equipped with the intake system for introducing the intake air to cylinders. In the intake system of the engine, an element of an air cleaner removes the dust in the intake air, a resonance chamber reduces the intake noise, and an intake manifold introduces the intake to the respective cylinders.

There are some conventional intake systems of the engine which include an air cleaner that has an element disposed between upper and lower casings and that is integrated to an engine cover covering the top of the engine. Such conventional intake systems are disclosed in JP Laid-Open No. H11-125158 and JP Laid-Open No. 2003-161217.

However, in the conventional intake system of the engine, a filtering surface of the element located between the upper and lower casings is positioned generally horizontally. On this account, the intake air that flows generally horizontally along a lower surface of the engine cover should turn in a vertical direction (up and down) to pass the element. This results in an undesirable increase in the resistance of the intake air.

Also, the conventional intake system of the engine includes an intake duct for introducing the outside air to the air cleaner that extends longitudinally of the vehicle along the lower surface of the engine cover. On this account, when a resonance chamber casing that is connected to the air cleaner through a communication pipe is formed on the lower surface of the engine cover, an inner space of the engine cover is divided into two right and left spaces by the intake duct. The capacity of the resonance chamber is therefore not large enough, which detriments the effect of silencing noise and the intake noise cannot be reduced significantly.

Further, in the conventional intake system of the engine as disclosed in JP No. H11-125158, an inlet section of an upstream end of the intake duct opens to a front surface of the engine cover. On this account, the hot wind having passed a radiator forward of the engine is introduced upwardly along the engine and is inhaled by the intake duct, which increases the temperature of the intake air taken into the intake duct.

The purpose of the present invention is to provide an intake system of the engine which is disposed in a limited space above the engine, improves the engine performance by preventing increase in both the temperature and the resistance of the intake air, and also reduces intake noise.

SUMMARY OF THE INVENTION

The present invention provides an intake system of an engine, having the engine and a transmission arranged or oriented widthwise in a vehicle, an intake manifold attached rearward of the engine, the intake manifold having a top surface formed lower than a top surface of the engine, an air cleaner positioned above the intake manifold with an element positioned between upstream-side and downstream-side casings, and a lower half body that defines a space and is joined to a lower surface of an engine cover covering upper parts of the engine and the intake manifold so as to form the upstream side casing, an intake duct for introducing the outside air to the upstream-side casing, and a resonance chamber casing joined to the upstream-side casing through a communication pipe. In the intake system of the engine, a rear wall section extending downwardly is formed in the lower half body that is joined to a rear end of the engine cover. A mounting frame section for attaching the element is formed in the rear wall section. The upstream-side casing is formed forward of the rear wall section. The intake duct has a downstream end connected to a front surface of the upstream-side casing adjacent to the transmission. The intake duct extends widthwise of the vehicle and has an upstream end opened to a side edge of the engine cover adjacent to the transmission. The resonance chamber casing is joined to a side departing from the transmission through the communication pipe forward of the upstream-side casing. The resonance chamber casing is formed to extend along the full width of the engine cover so as to cover the front of the intake duct.

According to the present invention, the rear wall section extending downwardly is formed in the lower half body that is joined to the rear end of the engine cover, and the mounting frame section for attaching the filter element is formed in the rear wall section. Accordingly, the filtering surface of the filter element is disposed vertically. Further, the upstream-side casing is formed forward of the rear wall section in which the mounting frame section for attaching the element is formed. The intake duct has the downstream end connected to the front surface of the upstream-side casing adjacent to the transmission. Accordingly, the passage of the intake air flowing from the intake duct to the upstream-side casing, the filter element, and the downstream-side casing can be formed in a flat formation without bending up and down. This avoids increase in the resistance of the intake air to improve the engine performance. Moreover, the intake duct has a downstream end connected to the front surface of the upstream-side casing, and the upstream end opens to the side edge of the engine cover adjacent to the transmission. The resonance chamber casing is joined to the side departing from the transmission through the communication pipe forward of the upstream-side casing. The resonance chamber casing is formed to extend along the full width of the engine cover so as to cover the front of the intake duct. Accordingly, the capacity of the resonance chamber can be expanded along the full width of the engine cover, thereby enhancing the silence effect and reducing the intake noise.

According to the intake system for the engine of the present invention, the rear wall section extending downwardly is formed in the lower half body that is joined to the rear end of the engine cover, and the mounting frame section for attaching the element is formed in the rear wall section. The upstream-side casing is formed forward of the rear wall section. To the front surface of the upstream-side casing, the downstream end of the intake duct is connected. Accordingly, the passage of the intake air flowing from the intake duct to the upstream-side casing, the element, and the downstream-side casing can be formed in the flat formation without bending up and down. Further, the intake duct of which downstream end is connected to the front surface of the upstream-side casing, has the upstream end opened to the side edge of the engine cover adjacent to the transmission. The resonance chamber casing is joined to the side departing from the transmission through the communication pipe forward of the upstream-side casing. The resonance chamber casing is formed to extend along the full width of the engine cover so as to cover the front of the intake duct. Accordingly, the capacity of the resonance chamber can be expanded along the full width of the engine cover. Embodiments of the present invention will now be described in specific detail with reference to the drawings.

DETAILED DESCRIPTION

Figure 2:
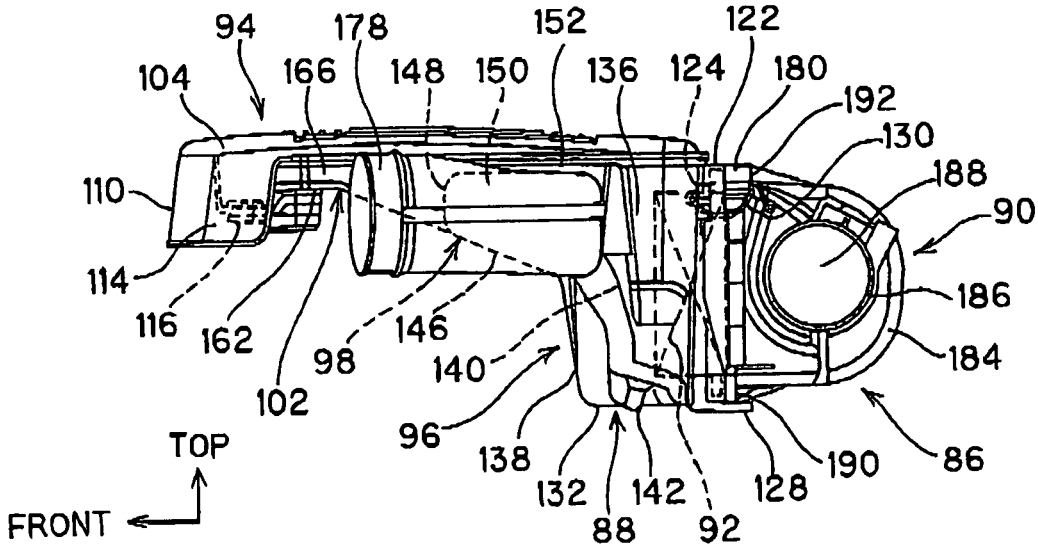
FIG. 2 is a side view of the intake system when viewed as indicated by an arrow II in FIG. 1.
Figure 3:
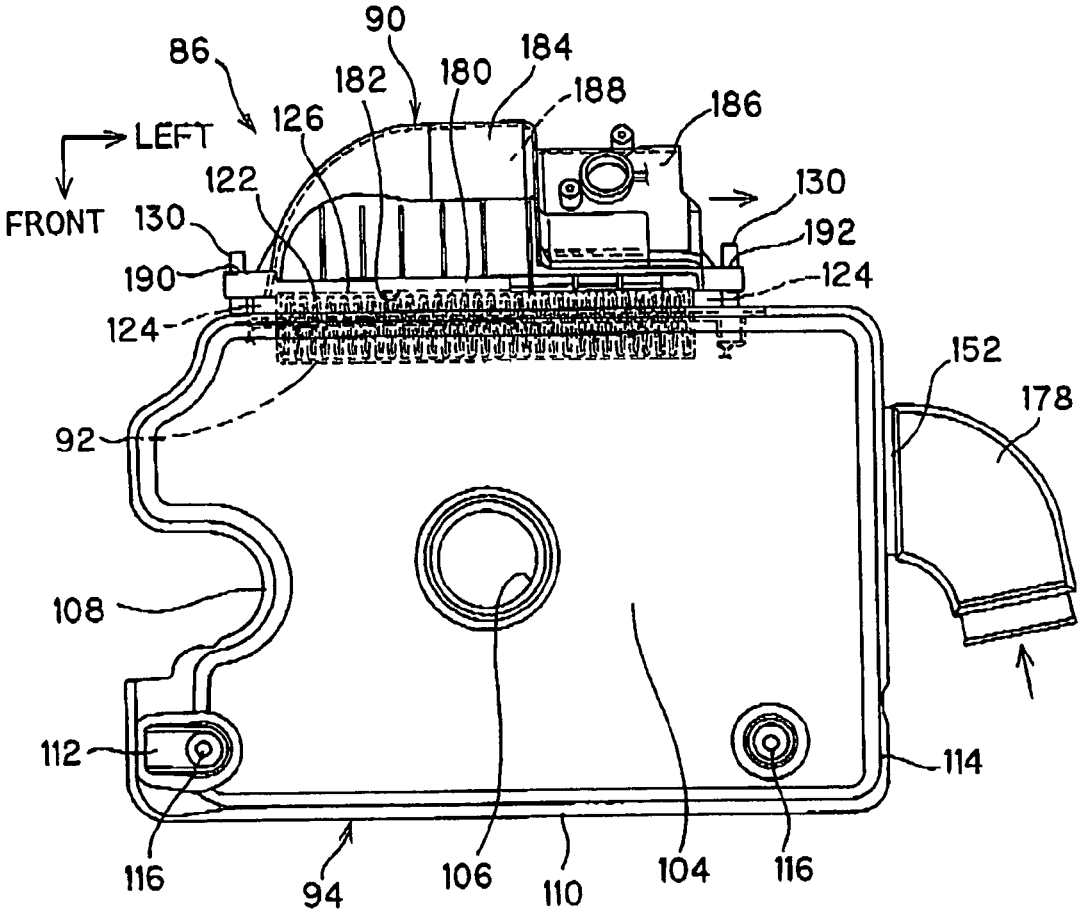
FIG. 3 is a plan view of the intake system.
Figure 4:
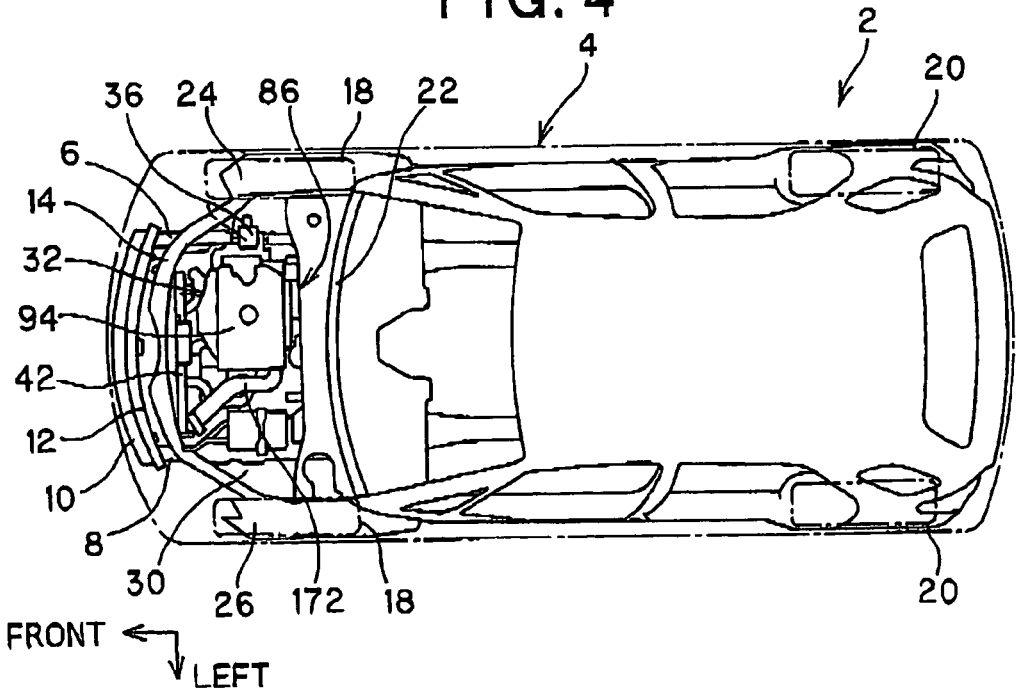
FIG. 4 is a plan view of the vehicle.
Figure 5:
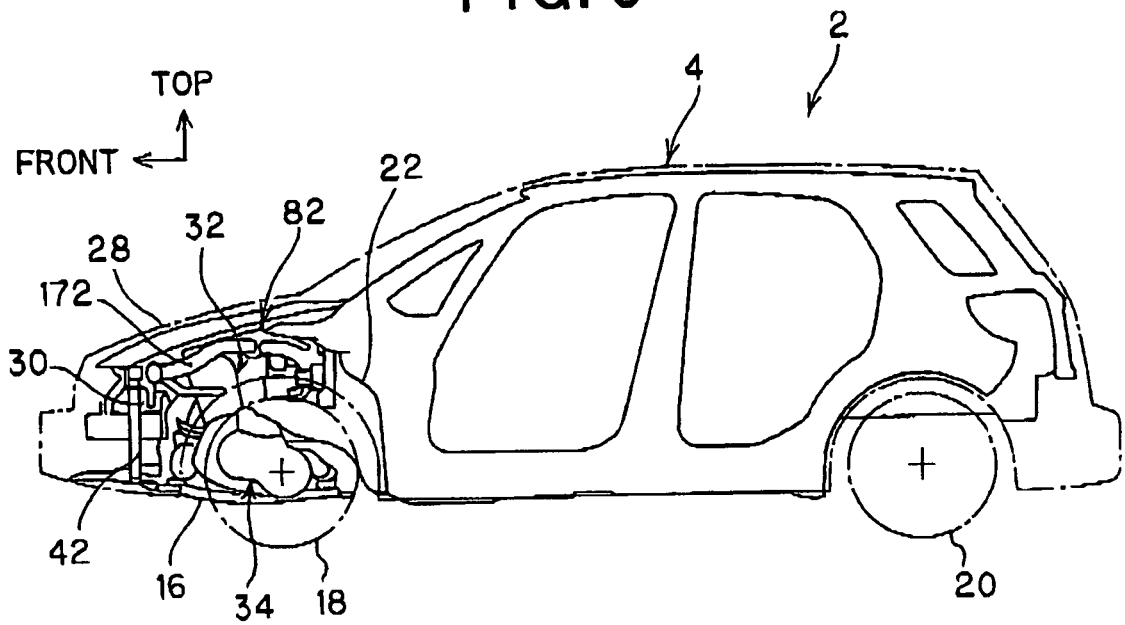
FIG. 5 is a side view of the vehicle.

FIGS. 1-9 illustrate an embodiment of the present invention. FIGS. 4 and 5 show a vehicle 2, a vehicle body 4, a right side frame 6, a left side frame 8, a front bumper member 10, a front cross member 12, a front upper member 14, a front center member 16, front vehicle wheels 18, and rear vehicle wheels 20. The vehicle 2 includes an engine room 30 which is separated by a dash panel 22 extending widthwise of the vehicle body 4 and which is enclosed by a right fender 24, a left fender 26, and an engine hood 28 forward of the dash panel 22.

In the engine room 30, an engine 32 and a transmission 34 are arranged side-by-side transversely of the length of the vehicle 2. As shown in FIGS. 6-9, the engine 32 is inclined toward a front side and is supported by a right engine mount 36, a left engine mount, a front engine mount 38, and a rear engine mount 40. The engine 32 is mounted rightward of the engine room 30. The transmission 34 is connected to a joint surface F on a left side of the engine 32 and is mounted leftward of the engine room 30.

In the engine room 30, a rectangular radiator 42 is disposed between the front cross member 12 and the front-upper member 14 forward of the engine 32 and transmission 34. The radiator 42 includes a radiator fan 44 on a rear side and a reserve tank 46 in a generally center upper part, and is connected to the engine 32 through radiator inlet and outlet pipes 48, 50. Also, in the engine room 30, a brake master back 52 and an ABS (anti-lock brake system) unit 54 are attached to the dash panel 22 rearward of the engine 32 and the transmission 34. Further, in the engine room 30, a battery 56 is mounted on the left side frame 8 above and leftward of the transmission 34.

Figure 8:
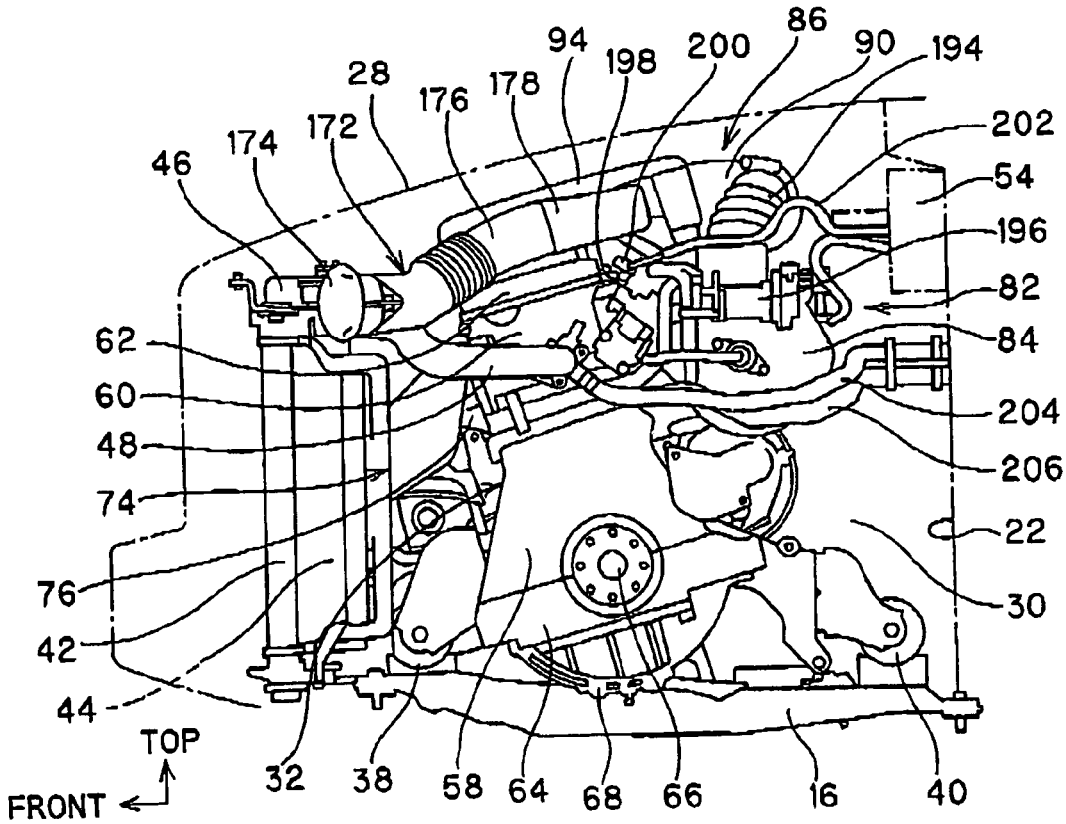
FIG. 8 is a left side view of the engine room when viewed as indicated by an arrow VIII in FIG. 7.

As shown in FIG. 8, the engine 32 is equipped with a cylinder head 60 on top of a cylinder block 58, a cylinder head cover 62 on the cylinder head 60, a crank case 64 on the lower side of the cylinder block 58 to support a crank shaft 66, and an oil pan 68 at the bottom of the crank case 66. Adjacent the right side of the cylinder head cover 62, an oil filler cap 70 is removably attached. Also the engine 32 has a chain cover 72 rightward of the cylinder block 58 and cylinder head 60. The transmission 34 is disposed leftward of the cylinder block 58, the crank case 64, and the oil pan 68.

Figure 9:
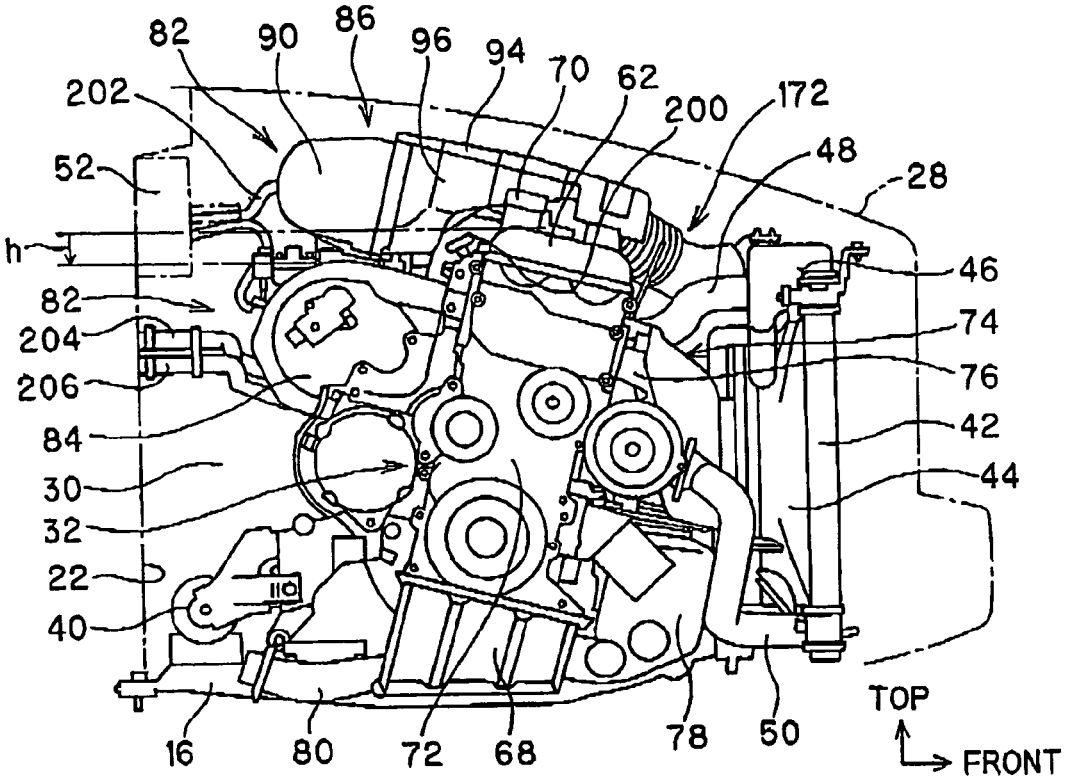
FIG. 9 is a right side view of the engine room when viewed as indicated by an arrow IX in FIG. 7.

As shown in FIG. 9, the engine 32 is equipped with an exhaust manifold 76 that forms an exhaust system 74 forward of the cylinder head 60. The exhaust system 74 includes a catalytic converter 78 connected to the exhaust manifold 76, and an exhaust pipe 80 extending rearwardly of the vehicle 2 and connected to the catalytic converter 78.

Figure 1:
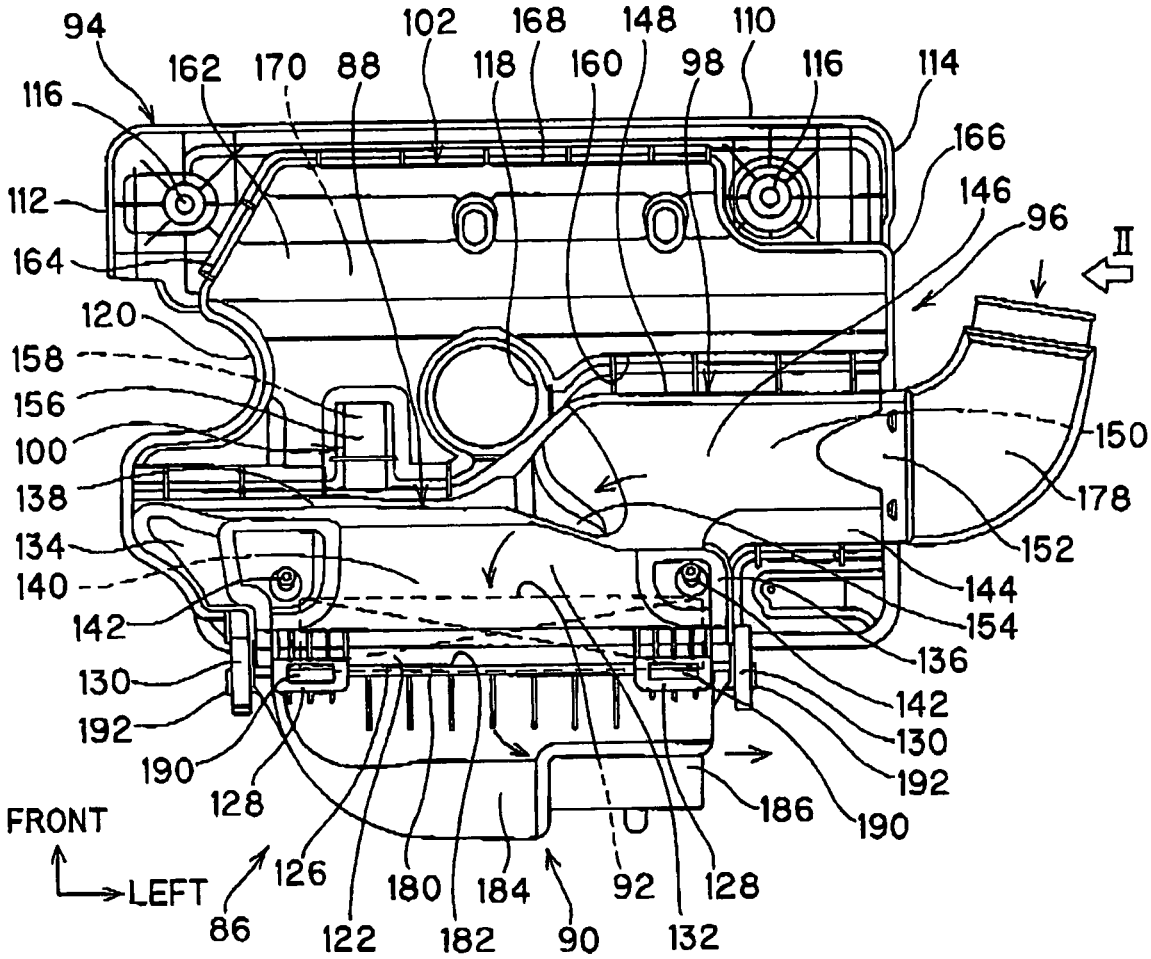
FIG. 1 illustrates a bottom view of the intake system of the engine according to the embodiment of the present invention.

The engine 32 is provided with an intake manifold 84 forming apart of an exhaust system 82 rearward of the cylinder head 60. As shown in FIG. 9, the top surface of the intake manifold 84 is formed to be lower than a top surface of the cylinder head cover 62 by a height "h". An air cleaner 86 is disposed above the intake manifold 84. As shown in FIGS. 1-3, the air cleaner 86 has an element 92 positioned between upstream-side and downstream-side casings 88, 90.

As shown in FIGS. 1-3, in the intake system 82, an engine cover 94 is an upper half body that covers top portions of the engine 32 and the intake manifold 84. In a space enclosed by the engine cover 94 and a lower half body 96 joined to the lower surface of the engine cover 94, are formed an upstream-side casing 88, an intake duct 98 for introducing the outside air to the upstream-side casing 88, and a resonance chamber casing 102 connected to the upstream-side casing 88 through a communication pipe 100.

Figure 6:
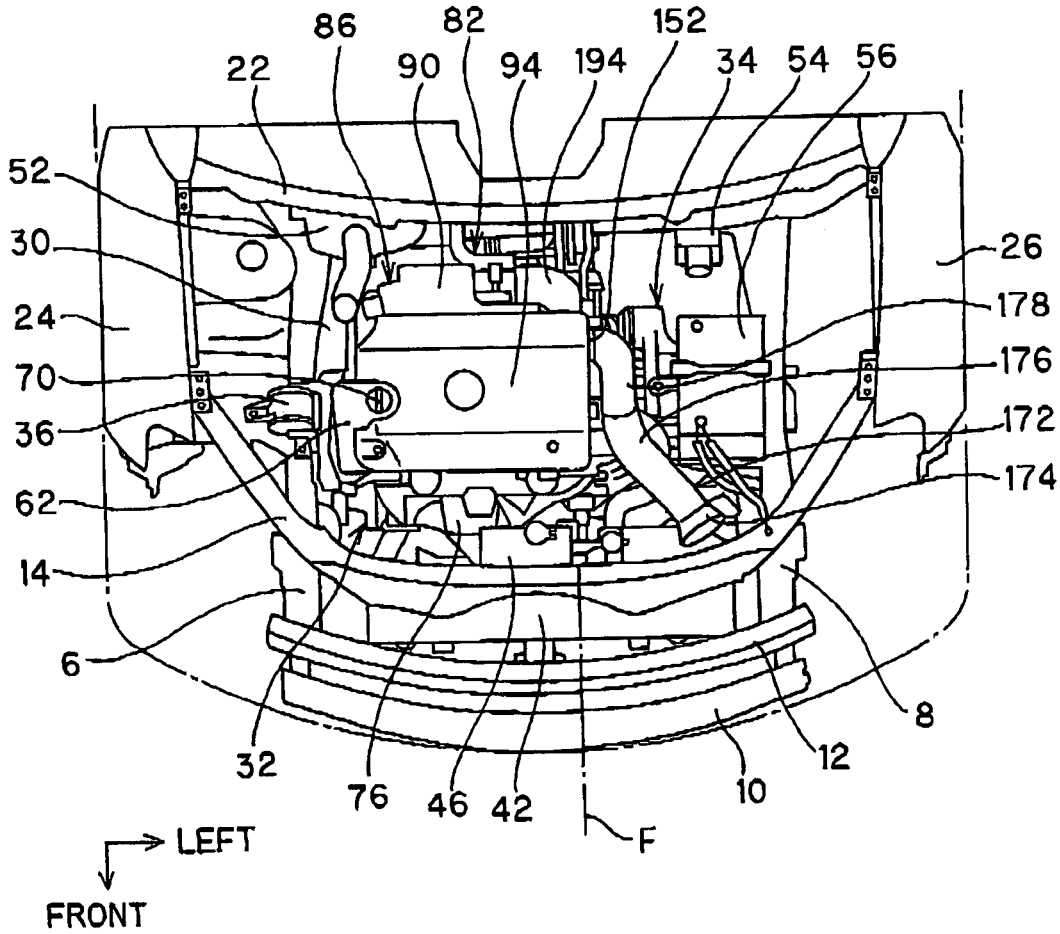
FIG. 6 is a plan view of the engine room.
Figure 7:
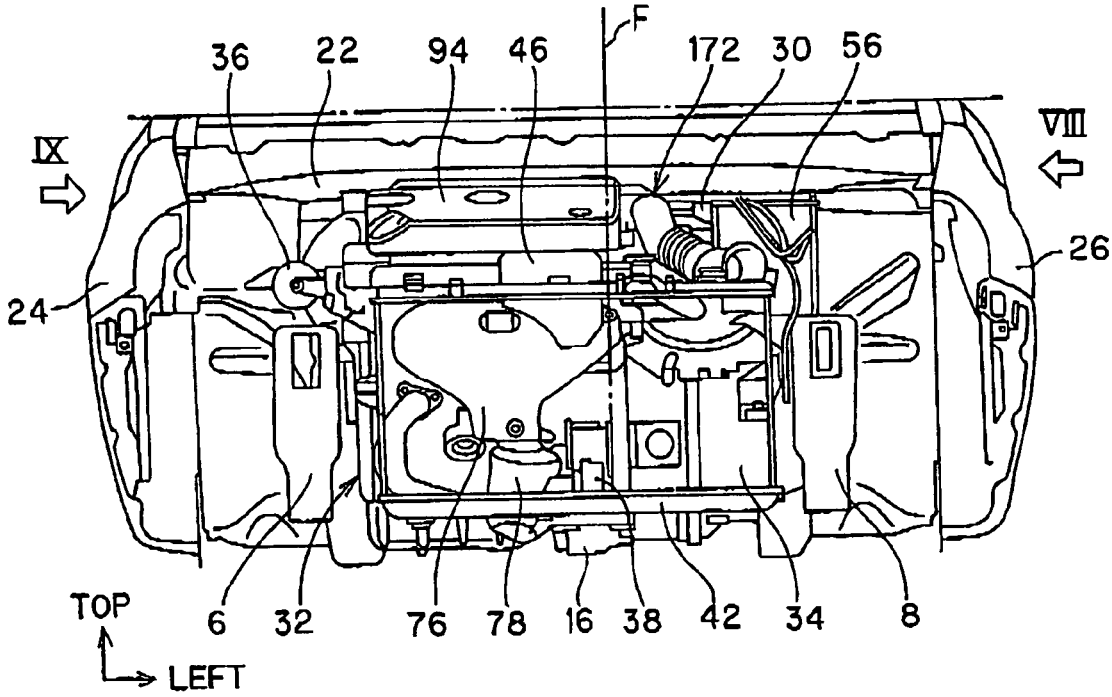
FIG. 7 is a front view of the engine room.

In the engine cover 94, i.e. the upper half body, an upper through-hole 106 is formed generally at a center of a rectangular upper wall 104 for passing an oil level gauge. A generally U-shaped upper recess 108 for avoiding interference with the oil filler cap 70 is formed on a right edge. A front wall 110 extends downwardly from a front edge. Right and left walls 112, 114 extend downwardly from right and left edges continuously with the front wall 110, thereby forming a lid shape. On the upper wall 104, a hole 116 is formed adjacent the right and left edges for mounting to the cylinder head cover 62. As shown in FIGS. 6 and 7, the engine cover 94 has the left edge protruding widthwise of the vehicle 2 toward the transmission 34 with respect to the joint surface F between the engine 32 and the transmission 34.

As shown in FIGS. 1 and 2, the lower half body 96 joined to the bottom of the engine cover 94 includes: a lower through-hole 118 corresponding to the upper through-hole 106; a lower recess section 120 corresponding to the upper recess 108; and a rear wall section 122 extending downwardly formed at a portion joined to the rear edge of the engine cover 94. The rear wall section 122 has a mounting frame section 124 for attaching the element 92 and integrates the upstream-side casing 88 forward of the rear wall section 122. The rear wall section 122 includes an upstream-side joint section 126 for joining the downstream-side casing 90 to the rear of the mounting frame section 124. Engaging sections 128 are formed in a rectangular frame shape at both lower ends of the upstream-side joint section 126. Locking members 130 are rotatably supported at both sides of the upper part of the upstream-side joint section 126.

The upstream-side casing 88 includes a bottom wall 132 extending forwardly from the lower edge of the rear wall section 122. Right and left walls 134, 136 rise from both edges of the bottom wall 132 and continue with both ends of the bottom wall 132. A front wall 138 rises from the front edge of the bottom wall 132 and continues with the right and left walls 134, 136. Thereby, a boxy shape is formed which defines an upstream side chamber 140. The front wall 138 has a right portion generally in parallel with the rear wall section 122 and a left portion extending slantwise rearwardly from a center portion that protrudes forwardly. Adjacent the right and left walls 134 and 136, the bottom wall 132 includes a protruding section 142 for an attachment to the intake manifold 84.

The intake duct 98 includes a rear wall 144 that extends toward a left edge of the engine cover from a left edge of the front wall 138 of the upstream-side casing 88. A bottom wall 146 is inclined forwardly from the lower edge of the rear wall 144 and the left side of the front wall 138 of the upstream-side casing 88. A front wall 148 rises before the bottom wall 146. Thereby a generally dipper shape is formed which defines an intake duct passage 150. The rear wall 144 is formed to be parallel with the rear wall section 122 of the upstream-side casing 88. The front wall 148 is formed to extend forwardly diagonally from a center portion of the front wall 138 of the upstream-side casing 88 while avoiding the lower through-hole 118 and to be in parallel with the front wall 138 of the upstream-side casing 88.

The intake duct 98 extends leftwardly in the width direction of the vehicle 2. An inlet section 152 of an upstream end orients leftwardly to open to the left edge of the engine cover 94 adjacent the transmission 34. An outlet section 154 of a downstream end is connected to the left section adjacent the transmission 34 at the front wall 138 of the upstream-side casing 88.

The communication pipe 100 forms a surrounding wall section 156 extending forward of a right part of the front wall 138 of the upstream-side casing 88, which is formed in a dipper shape that defines a communicating passage 158.

The resonance chamber casing 102 includes a rear wall 160 which is in parallel with both the front wall 138 of the upstream-side casing 88 and the front wall 148 of the intake duct 98, and which extends downwardly before the upstream-side casing 88 while avoiding the lower through-hole 118 and the communication pipe 100. A bottom wall 162 extends upwardly from the lower edge of the rear wall 160 while avoiding the mounting hole 116 and the lower recess 120. Right and left walls 164 and 166 rise from both ends of the bottom wall 162 and are continuously with the rear wall 160. A front wall 168 rises from a front end of the bottom wall. 162 and is continuously with the right and left walls 164 and 166. Thereby a boxy shape is formed which defines a resonance chamber 170.

The resonance chamber casing 102 is connected to the upstream-side casing 88 through the communication pipe 100 forward of the upstream-side casing 88 of the front wall 138 at a right portion spaced apart from the transmission 34, thereby communicating the resonance chamber 170 to an upstream-side chamber 140. The resonance chamber casing 102 is formed to extend along the full width of the engine cover 94 to cover the front portion of the intake duct 98.

As shown in FIG. 2, in the lower half body 96, the bottom wall 162 of the resonance chamber casing 102 is inclined or angled to be positioned lower toward the upstream-side casing 88, when viewed from the side of the vehicle 2. The bottom wall 132 of the upstream-side casing 88 is positioned lower than the bottom wall 162 of the resonance chamber casing 102. As shown in FIG. 1, in the lower half body 96, the upstream end of the intake duct 98 opens to the left edge of the engine cover 94 adjacent the transmission 34. The inlet section 152 of the intake duct 98 opens to a portion adjacent the upstream-side casing 88.

As shown in FIGS. 6 and 7, the engine cover 94 has the left edge, adjacent the transmission 34 that protrudes widthwise of the engine 2 toward the transmission 34 with respect to the joint surface F between the engine 32 and the transmission 34. An air inlet duct 172 shown in FIG. 8 is connected to the inlet section 152 that orients to the left side of the intake duct 98 that opens to the left edge of the engine cover 94 that protrudes toward the transmission 34. The air inlet duct 172 includes at an upstream end thereof an inlet hole section 174, at an intermediate portion a hose section 176, and at a downstream end a duct section 178, which are shaped in a cylindrical shape. In order to avoid inhale of the hot wind having passed through the radiator 42, the air inlet duct 172 has at the upstream end the inlet hole section 174 disposed above and forward of the transmission 34 and in a left corner of the engine room 30 away from the radiator 42. The intermediate hose section 176 extends rearwardly of the vehicle above the transmission 34. The duct section 178 at the downstream end is bent toward the engine 32 to be connected to the inlet section 152 of the intake duct 98.

Accordingly, the air inlet duct 172 in connection to the inlet section 152 of the intake duct 98 that opens to the left edge of the engine cover 94, extends to the space above and the left of the engine room 30 away from the radiator 42 above and forward of the transmission 34.

As shown in FIGS. 1-3, the downstream-side casing 90 joined to the upstream-side casing 88 includes a front wall 180 corresponding to the rear wall section 122. A downstream-side joint section 182 abutting the downstream-side joint section 126 is formed in the front wall 180. A rear surrounding wall 184, in a semi-cylindrical shape, is formed which expands rearwardly and extends toward the left side while abutting right, upper, and lower edges of the front wall 180. An outlet section 186 is formed at a left edge of the rear surrounding wall 184 to open toward the left side. Thereby a boxy shape is formed which defines a downstream-side casing chamber 188. In the downstream-side casing 90, protrusions 190 are formed at lower both ends of the downstream-side joint section 182 to be engaged with the engage section 128. Also locking recesses 192 are formed at upper both sides of the lower-side joint section 182 to elastically lock the locking member 130.

The downstream-side casing 90 is joined to the upstream-side casing 88 in a manner that: the downstream-side joint section 182 abuts the upstream-side joint section 126 of the upstream-side casing 88 that attaches the element 92 to the mounting frame section 124; the protrusion 190 is engaged with the engaging section 128 of the upstream-side casing 88; and the locking member 180 of the upstream-side casing 88 is locked to the locking recess 192.

The outlet section 186 of the downstream-side casing 90 is connected to the air outlet duct 194 shown in FIG. 8. The air outlet duct 194 is formed in a cylindrical shape and is bent downwardly toward rear of the engine 32 to be connected to a throttle body 196. The throttle body 196 is connected to the intake manifold 84.

Rearward of the cylinder head 60 of the engine 32 to which the intake manifold 84 is attached, a fuel injection valve 198 is mounted which is connected to a fuel delivery pipe 200. The fuel delivery pipe 200 is connected to a fuel supply piping 202. The fuel injection valve 198 and the delivery pipe 200 are positioned rearward of the cylinder head 60, and in a space surrounded by both the intake manifold 84, which is attached to the rear side of the cylinder head 60, and the upstream-side casing 88 of the lower half body 96 that covers the intake manifold 84. The fuel supply piping 202 is introduced rearwardly along a left side of the air outlet duct 194. Below the fuel supply piping 202 and sideward of the intake manifold 84, a heater inlet piping 204 and a heater outlet piping 206 are positioned.

Operation of the embodiment of the present invention is explained as follows.

In the intake system 82 of the engine 32, the air at a low temperature before passing the radiator 42 is taken from the air inlet duct 172. The taken air is introduced through the intake duct 98 to the upstream-side casing 88, and filtered with the element 92, and then introduced to the downstream-side casing 90. Although the cooling wind having passed the radiator 42 is supplied to below the intake duct 98, due to positioning of the intake duct 98 above the transmission 34, the cooling wind can be discharged or passed rearwardly through the space above the transmission 34. This prevents the intake duct from being heated by the cooling wind and therefore prevents increasing of the temperature of the intake air, which improves the engine performance. In addition, the intake duct 98, the upstream-side casing 88, and the downstream-side casing 90 are positioned in series along the longitudinal direction of the vehicle 2 so as to decrease the resistance of the intake air and thus improve the engine performance. The intake air introduced to the downstream-side casing 90 is discharged from the outlet section 186 of the downstream-side casing 90 that opens toward the transmission 34 to avoid interference with the rearward dash panel 22. The intake air is then introduced to the intake manifold 84 through the outlet duct 194 bent downwardly and the throttle body 196 disposed below, and is supplied to each cylinder of the engine 32. Further, the intake noise generated in the passage is reduced by the resonance chamber 170 communicated to the upstream-side casing 88 through the communication pipe 100.

In the intake system 82, the top surface of the intake manifold 84 attached to the rear side of the engine 32 is formed to be lower than the top surface of the engine 32. Also the air cleaner 86, having the element 92 positioned between the upstream-side casing 88 and the downstream-side casing 90, is disposed above the intake manifold 84. The lower half body 96, which defines the space, is joined to the lower surface of the engine cover 94 covering the top portions of the engine 32 and the intake manifold 34 so as to form the upstream-side casing 88, the intake duct 98 that introduces the outside air to the upstream-side casing 88, and the resonance chamber casing 102 in communication with the upstream-side casing 88 through the communication pipe 100.

In the intake system 82, the rear wall section 122 extending downwardly is formed in the lower half body 96 that is joined to the rear edge of the engine cover 94, and the mounting frame section 124 is formed in the rear wall section 122 to which the element 92 is attached. Accordingly, the filtering surface of the element 92 is disposed vertically. The upstream-side casing 88 is formed forward of the rear wall section 122 having the mounting frame section 124 of the element 92. To the front surface and on the left side of the upstream-side casing 88 adjacent the transmission 34, the downstream end of the intake duct 98 is joined.

Accordingly, in the intake system 82, the passage of the intake air flowing from the intake duct 98 to the upstream-side casing 88, the element 92, and the downstream-side casing 90 can be formed in a flat formation without bending up and down. This reduces the increase in the resistance of the intake air and therefore improves the engine performance.

In addition, in the intake system 82, the intake duct 98 of which the downstream end is connected to the front surface of the upstream-side casing 88, has the upstream end opened to the left edge of the engine cover 94 adjacent the transmission 34. The resonance chamber casing 102, connected to the front surface and right side of the upstream-side casing 88 away from the transmission 34 through the communication pipe 100, is formed to extend along the full width of the engine cover 94 to cover the front portion of the intake duct 98.

Consequently, the intake system 82 permits the capacity of the resonance chamber 170 to expand along the full width of the engine cover 94, thereby enhancing the silence effect and reducing the intake noise.

In addition, in the intake system 82, the bottom wall 162 of the resonance chamber casing 102 is inclined or angled toward the upstream-side casing 88. Also the bottom wall 132 of the upstream-side casing 88 is positioned lower than the bottom wall 162 of the resonance chamber casing 102. Accordingly, the upstream-side casing 88 has a sufficient height behind the lower half body 96. Adjacent the upstream-side casing 88 having the sufficient height, the inlet section 152 at the upstream end of the intake duct 98 is opened. Accordingly, this avoids flattening of the inlet section 152 of the intake duct 98, which decreases the resistance of the intake air.

In the intake system 82, the engine cover 94 has the left edge protruding toward the transmission 34 with respect to the joint surface F between the engine 32 and the transmission 34. The air inlet duct 172 is connected to the inlet section 152 of the intake duct 98 opening to the left edge of the engine cover 94 protruding toward the transmission 34. Then the air inlet duct 172 extends forward of the transmission 34 and above the space, not above the engine 32. Thereby, the inlet duct 172 is not limited by the height of the engine cover 94 above the engine 32, which does not require an unduly flattening of the air inlet duct 172 while reducing the intake resistance.

The present invention is not limited to the above, but is susceptible to various variations or modifications.

Figure 10:
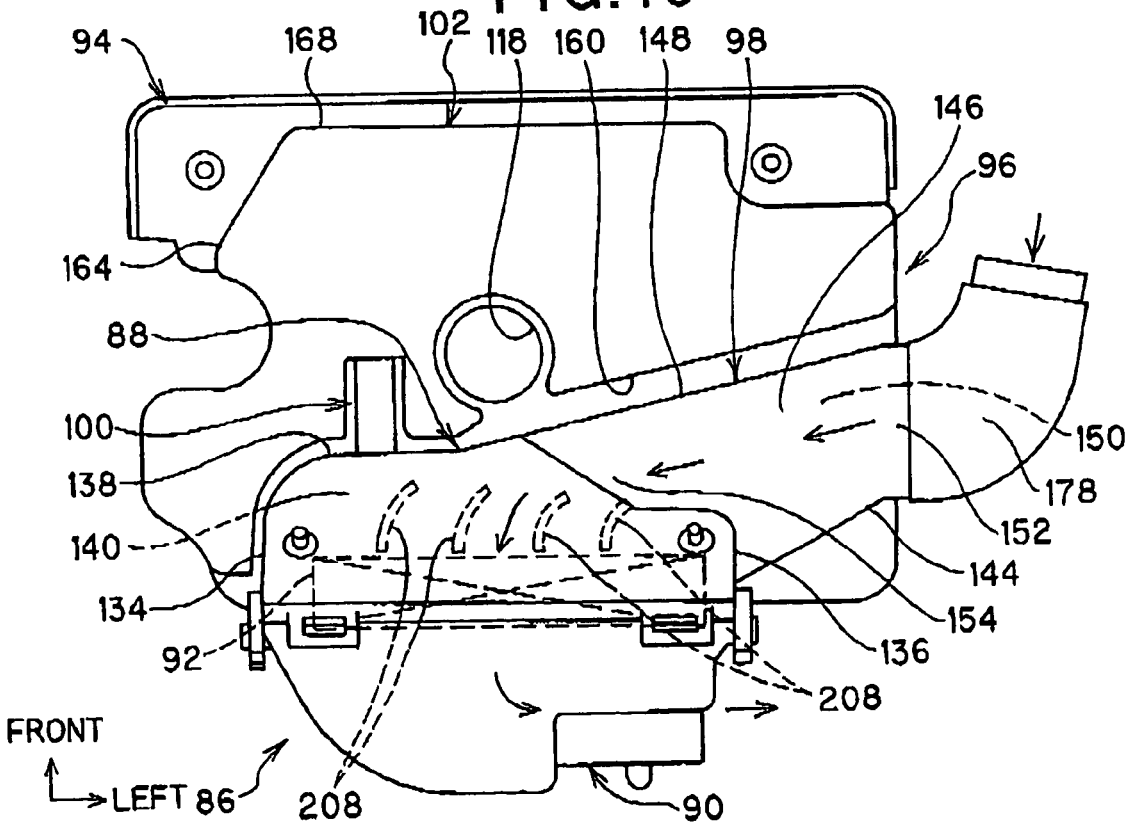
FIG. 10 is a schematic bottom view of another embodiment of the intake system of the engine.

For example, FIG. 10 illustrates a variation of the intake system 82 of the engine 32. In the intake system 82, the right wall 134, which rises from right side of the bottom wall 132 of the upstream-side casing 88 and that begins from right edge of the rear wall 122, has a front portion bent toward the left side to smoothly join to the front wall 138. The rear wall 144 of the intake duct 98 is formed to extend straight from the rear end of the left wall 136 of the upstream-side casing 88 to the slant forward left side edge of the engine cover. The front wall 148 of the intake duct 98 is formed to extend straight from the center portion of the front wall 138 of the upstream-side casing 88 to the slant forward left side edge of the engine cover while avoiding the lower through-hole 118. In the bottom wall 132 of the upstream-side casing 88, a guide plate 208 is disposed to conduct to the element 92 the intake air flow to the upstream side chamber 140 from the outlet section 154 of the intake duct 98.

In the intake system 82, due to the straight formation of the intake duct passage 150 of the intake duct 98 from the inlet section 152 to the outlet section 154 to communicate to the upstream side chamber 140, the resistance of the intake air can be reduced without turning the flow of the intake air. Due to the guide plate on the bottom wall 132 of the upstream-side casing 88, the intake air flowed into the upstream side chamber 140 can be smoothly introduced to the element 92, reducing the resistance of the intake air.

Further, in the intake system 82, the right wall 134, which rises from the right side of the bottom wall 132 of the upstream-side casing 88 and that begins from the right edge of the rear wall 122, has the front portion bent toward the left side to smoothly join to the front wall 138, and the front wall 148 of the intake duct 98 is formed to extend straight to the slant forward left side edge of the engine cover. Accordingly, the resonance chamber casing 102 has a right part of the rear wall 160 extended rearwardly toward the right end of the rear wall 122 of the upstream-side casing 88. Also, a left part of the rear wall 160 of the resonance chamber casing 102 with respect to the lower through-hole 118 can be formed to extend straight along the front wall 148 of the intake duct 98 toward the slant forward left edge of the engine cover. Accordingly, the capacity of the resonance chamber 170 can be expanded toward the rear of the engine cover 94, so that silence effect of the noise can be improved to reduce the noise of the intake.

According to the present invention, the passage of the intake air flowing from the intake duct to the upstream-side casing, the element, and the downstream-side casing can be formed in a flat formation without bending up and down. The capacity of the resonance chamber casing including the engine cover and the lower half body can be expanded along the full width of the engine cover, which can be applied to the intake system of the engine mounted on the vehicle.

What is claimed is:

1. An intake system of an engine, having the engine and a transmission arranged side-by-side in a widthwise direction of a vehicle, an intake manifold attached rearward of the engine, the intake manifold having a top surface formed lower than a top surface of the engine, an air cleaner positioned above the intake manifold with an element positioned between upstream-side and downstream-side casings, and a lower half body that defines a space and that is joined to a lower surface of an engine cover covering upper parts of the engine and the intake manifold so as to form the upstream side casing, an intake duct for introducing the outside air to the upstream-side casing, and a resonance chamber casing joined to the upstream-side casing through a communication pipe, comprising:

a rear wall section extending downwardly formed in the lower half body that is joined to a rear end of the engine cover;

a mounting frame section formed in the rear wall section for attaching the element;

the upstream-side casing formed forward of the rear wall section;

the intake duct having a downstream end connected to a front surface of the upstream-side casing adjacent to the transmission;

the intake duct extending widthwise of the vehicle and having an upstream end opened to a side edge of the engine cover adjacent to the transmission;

the resonance chamber casing joined to a side departing from the transmission through the communication pipe forward of the upstream-side casing; and the resonance chamber casing formed to extend along the full width of the engine cover so as to cover the front of the intake duct.

2. The intake system of the engine according to claim 1, wherein the lower half body has a bottom wall of the resonance chamber casing angled to be positioned lower toward the upstream-side casing, when viewed from the side of the vehicle, wherein a bottom wall of the upstream-side casing is positioned lower than the bottom wall of the resonance chamber casing, and wherein an inlet section of the intake duct of which upstream end opens to a side edge of the engine cover adjacent the transmission, opens to a portion adjacent the upstream-side casing.

3. The intake system of the engine according to claim 1, wherein the engine cover has a side edge, adjacent the transmission, protruding widthwise of the vehicle toward the transmission with respect to a joint surface between the engine and the transmission, and wherein an air inlet duct is connected to an inlet section of the upstream end of the intake duct that opens to the side of the engine cover that protrudes toward the transmission, and the air inlet duct is disposed to extend to a space above and forward of the transmission.

* * * * *